US005603131A

United States Patent [19]

DeJean, Jr.

[11] Patent Number: 5,603,131

[45] Date of Patent: Feb. 18, 1997

[54] WATER FILLED MATTRESS WITH WATER CIRCULATING PUMP

[76] Inventor: Prescott L. DeJean, Jr., 1501 Loop 165, Dripping Springs, Tex. 76820

[21] Appl. No.: 577,694

[22] Filed: Dec. 22, 1995

[51] Int. Cl.[6] ..... A47C 27/08

[52] U.S. Cl. ..... 5/672; 5/711

[58] Field of Search ..... 5/451, 457, 421, 5/422, 454, 449, 453, 455, 644

[56] References Cited

U.S. PATENT DOCUMENTS

| | | | |
|---|---|---|---|
| 2,465,268 | 3/1949 | Rogers et al. | 5/457 |
| 3,848,282 | 11/1974 | Viesturs | 5/451 |
| 4,459,714 | 7/1984 | Lin | 5/457 |
| 4,611,357 | 9/1986 | Chellin | 5/451 |
| 5,369,823 | 12/1994 | Hochschild, III | 5/451 |
| 5,406,661 | 4/1995 | Pekar | 5/454 |

*Primary Examiner*—Alexander Grosz

[57] ABSTRACT

A water filled mattress including a top sheet of flexible material that is capable of having a bottom sheet of flexible material joined by heat sealing. The top and bottom sheet are joined at their peripheries and form a waterproof enclosure. The waterproof enclosure is capable of retaining an amount of water. The waterproof enclosure has a circumferential border with a front end and a rear end. A plurality of heat welds intermittently join the top sheet and the bottom sheet to form a plurality of seams. Each seam is linearly aligned along the waterproof enclosure. Each seam ends at an identical distance. A headrest is formed within the waterproof enclosure adjacent the seam ending. The mattress has a fill valve and a drain valve and an elongated tubular hose, having a first end connected to the fill valve, a second end connected to the drain valve, a bulb pump located between the first and second end of the hose, whereby upon the repeated squeezing of the bulb pump, the water contained in the enclosure is circulated between the front and rear portions of the mattress. Lastly, a lid that has a projection is positioned within a fill opening of the front end to capture the amount of water within the waterproof enclosure.

5 Claims, 3 Drawing Sheets

WATER FILLED MATTRESS WITH WATER CIRCULATING PUMP

BACKGROUND OF THE INVENTION

1. Field of the Invention

The present invention relates to a water filled mattress and more particularly pertains to providing a waterproof enclosure that can support the body by way of water chambers and a water-filled pillow portion, and further enclosing the water within with a unique hinged lid.

2. Description of the Prior Art

The use of water mattress is known in the prior art. More specifically, water mattresses heretofore devised and utilized for the purpose of supporting a person are known to consist basically of familiar, expected, and obvious structural configurations, notwithstanding the myriad of designs encompassed by the crowded prior art which has been developed for the fulfillment of countless objectives and requirements.

By way of example, U.S. Pat. No. Des. 341,981 to Harris discloses a water filled seat pad. U.S. Pat. No. 5,065,465 to Nystad discloses a water mattress for a therapy waterbed. U.S. Pat. No. 4,860,395 to Smith discloses a water-cooled lounging pad. U.S. Pat. No. 4,136,412 to Wilhelm discloses an air mattress. U.S. Pat. No. 3,909,859 to Harris discloses a therapeutic water mattress. Lastly, U.S. Pat. No. 3,753,823 to Kuss discloses a method of manufacturing a water mattress.

While these devices fulfill their respective, particular objectives and requirements, the aforementioned patents do not describe water filled mattress that allows the waterproof enclosure to receive ice water for cooling in the summer or hot water for warming in the winter, through a fill opening, and provides a hose attachment with a pump for recirculating the water therein while the mattress is in use.

In this respect, the water filled mattress according to the present invention substantially departs from the conventional concepts and designs of the prior art, and in doing so provides an apparatus primarily developed for the purpose of providing a waterproof enclosure that can support the body by way of water chambers and a water filled pillow portion, and further enclosing the water within with a unique hinged lid.

Therefore, it can be appreciated that there exists a continuing need for a new and improved water filled mattress which can be used for providing a waterproof enclosure that can support the body by way of water chambers and a water filled pillow portion, and further enclosing the water within with a unique hinged lid. In this regard, the present invention substantially fulfills this need.

SUMMARY OF THE INVENTION

In view of the foregoing disadvantages inherent in the known types of water mattresses now present in the prior art, the present invention provides an improved water filled mattress. As such, the general purpose of the present invention, which will be described subsequently in greater detail, is to provide a new and improved water filled mattress and method which has all the advantages of the prior art and none of the disadvantages.

To attain this, the present invention essentially comprises a generally rectangular top sheet of flexible material. The top sheet of flexible material is capable of having a generally rectangular bottom sheet of flexible material coextensive therewith. The top sheet and the bottom sheet are joined by heat sealing at their peripheries to form a rectangular waterproof enclosure. The waterproof enclosure has a circumferential border and is capable of retaining an amount of water. The waterproof enclosure has a front end with a fill opening and a rear end. The waterproof enclosure is capable of supporting a person lying thereon. A plurality of heat welds intermittently join the top sheet and the bottom sheet. The heat welds are capable of forming a seam that has a linear alignment along the waterproof enclosure. The heat welds begin near the border along the rear end and the seam formed extends linearly for 70 percent of the waterproof enclosure. The linear alignment is capable of being duplicated along the waterproof enclosure and capable of forming a plurality of tubular rows of water chambers between each seam. Each seam is proportionately spaced within the waterproof enclosure. Each seam ending an identical distance that is spaced from the front end. A generally rectangular headrest is formed within the waterproof enclosure and adjacent the front end. Included is a generally rectangular lid. The lid has one end that is hingedly coupled to the front end of the waterproof enclosure adjacent the fill opening. The lid has a projection that is capable of being positioned within a fill opening of the front end to capture the amount of water within the waterproof enclosure. The lid is lockingly positioned over the fill opening by a wing nut that is secured to another end of the lid. Lastly, an elongated tubular hose is included. The hose has a first end that is attached to a fill valve, a second end that is attached to a drain valve and a bulb pump therebetween. The fill valve is coupled to a side of the border along the front end. The drain valve is coupled to the rear end of the waterproof enclosure. The hose is capable of providing circulation for the amount of water within the waterproof enclosure when the bulb is squeezed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved water filled mattress which has all of the advantages of the prior art water mattresses and none of the disadvantages.

It is another object of the present invention to provide a new and improved water filled mattress which may be easily and efficiently manufactured and marketed.

It is further object of the present invention to provide a new and improved water filled mattress which is of durable and reliable constructions.

An even further object of the present invention is to provide a new and improved water filled mattress which is susceptible of a low cost of manufacture with regard to both materials and labor, and which accordingly is then susceptible of low prices of sale to the consuming public, thereby making such water filled mattress economically available to the buying public.

Still yet another object of the present invention is to provide a new and improved water filled mattress which provides in the apparatuses and methods of the prior art some of the advantages thereof, while simultaneously overcoming some of the disadvantages normally associated therewith.

Even still another object of the present invention is to provide a water filled mattress for providing a waterproof enclosure that can support the body by way of water chambers and a water filled pillow portion, and further enclosing the water within with a unique hinged lid.

Lastly, it is an object of the present invention to provide a new and improved water filled mattress including a top sheet of flexible material is capable of having a bottom sheet of flexible material being joined by heat sealing. The top and bottom sheet are joined at their peripheries and form a waterproof enclosure. The waterproof enclosure is capable of retaining an amount of water. The waterproof enclosure has a circumferential border with a front end and a rear end. A plurality of heat welds intermittently join the top sheet and the bottom sheet to form a plurality of seams. Each seam is linearly aligned along the waterproof enclosure. Each seam ends at an identical distance. A headrest is formed within the waterproof enclosure adjacent the seam ending. Lastly, a lid that has a projection is positioned within a fill opening of the front end to capture the amount of water within the waterproof enclosure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
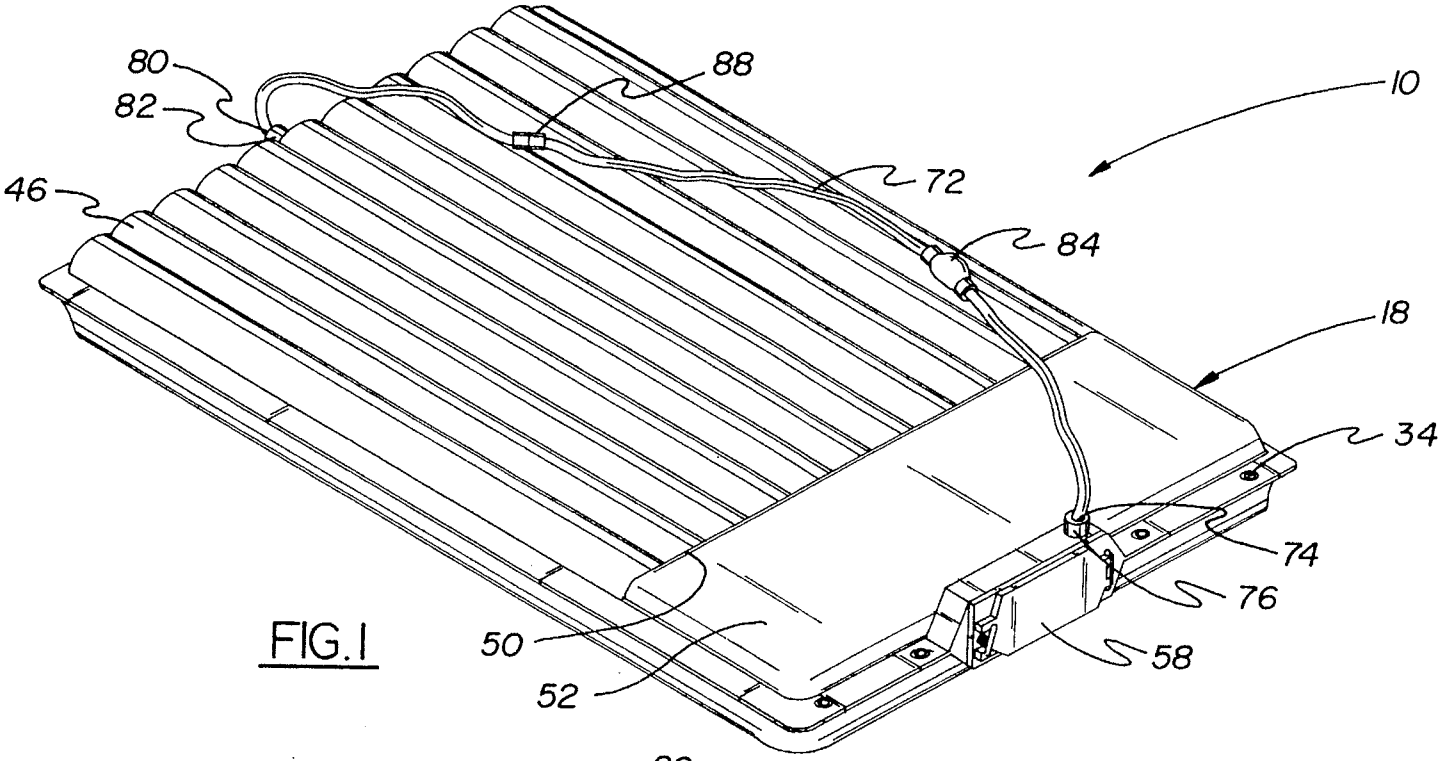
FIG. 1 is a perspective view of the preferred embodiment of the water filled mattress constructed in accordance with the principles of the present invention.

With reference now to the drawings, and in particular to FIG. 1 thereof, the preferred embodiment of the new and improved water filled mattress embodying the principles and concepts of the present invention and generally designated by the reference numeral 10 will be described.

The present invention, the water filled mattress 10 is comprised of a plurality of components. Such components in their broadest context include a waterproof enclosure, a lid, a pair of valves and a hose. Such components are individually configured and correlated with respect to each other so as to attain the desired objective.

Figure 2:
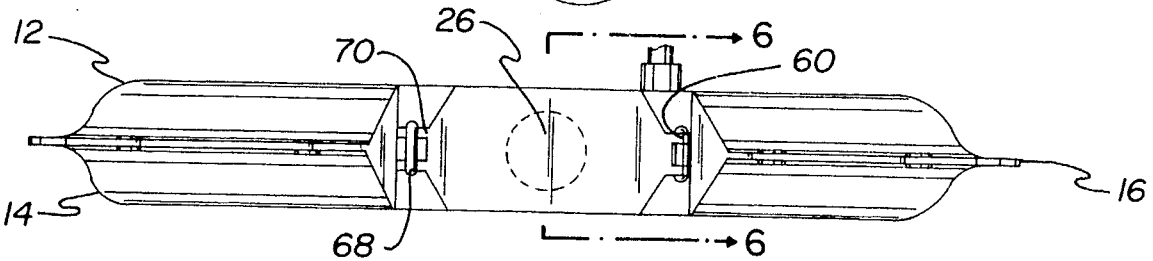
FIG. 2 is a front elevational view of the present invention of FIG. 1.

Specifically, the present invention includes a generally rectangular top sheet 12 of flexible material. The top sheet is capable of having a generally rectangular bottom sheet 14 of flexible material coextensive therewith. Each sheet is formed of a polyvinyl plastic. The plastic material that forms the sheets is useable in hot and cold environments. The top sheet and the bottom sheet are joined by heat sealing at their peripheries at 16, as shown in FIG. 2, and form a rectangular waterproof enclosure 18.

Figure 3:
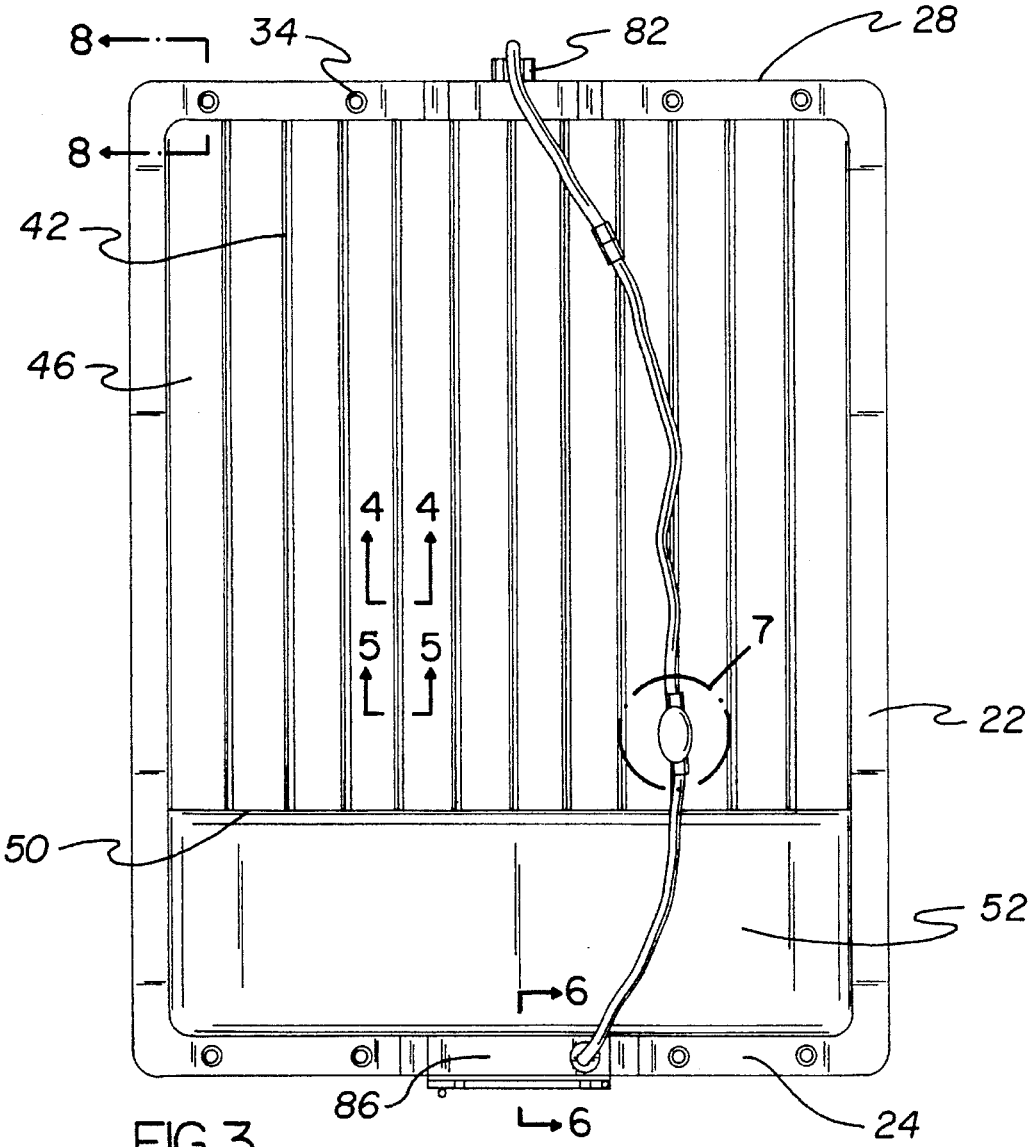
FIG. 3 is a top plan view of the present invention in an operable configuration.
Figure 8:
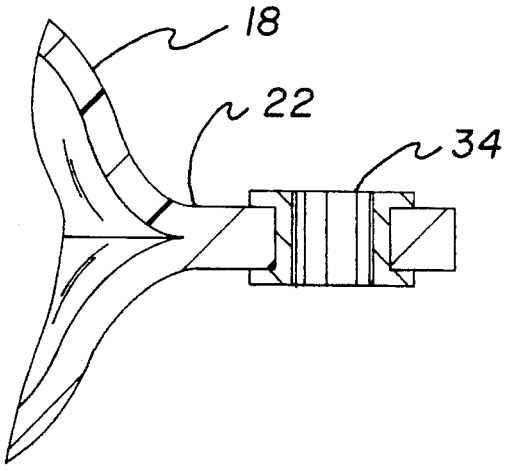
FIG. 8 is an enlarged cross sectional view of the grommet taken along line 8—8 of FIG. 3.

As illustrated in FIG. 3, the waterproof enclosure has a circumferential border 22. The border aids the waterproof enclosure with retaining an amount of water therein. The border of the waterproof enclosure has a front end 24 with a fill opening 26 and a rear end 28. The front end has a plurality of grommets 34 proportionately spaced along the border. Additionally, the rear end has a plurality of grommets proportionately spaced along the border. As seen in FIG. 8, each grommet 34 passes through the border. The grommets allow the waterproof enclosure to be hung vertical the ground for drying or storage.

Figure 4:
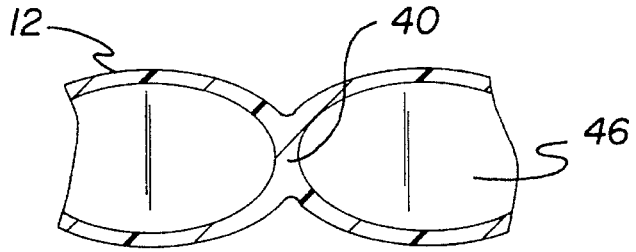
FIG. 4 is an enlarged cross sectional view taken substantially along line 4—4 of FIG. 3.
Figure 5:
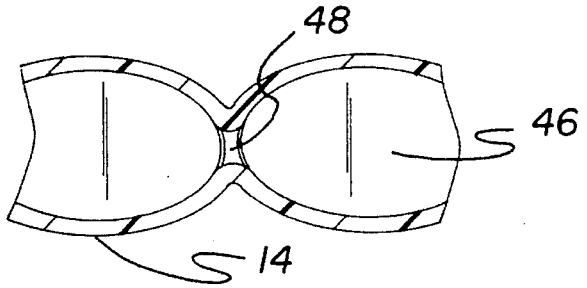
FIG. 5 is an enlarged cross sectional view taken substantially along line 5—5 of FIG. 3.

Also, a plurality of heat welds 40 intermittently join the top sheet and the bottom sheet. The heat welds, as seen in FIG. 4, are capable of forming a seam 42 that has a linear alignment along the waterproof enclosure 18. The seam is intermittent as determined by the heat welds. The heat welds, that form the seam, begin near the border along the rear end, as seen in FIG. 3. The seam formed, extends linearly for 70 percent of the waterproof enclosure. The linear alignment of heat welds are duplicated along the waterproof enclosure and form a plurality of tubular rows of water chambers between each seam. Between each heat weld, as seen in FIG. 5, a water passage 48 is created. The water passage allows a flow of water throughout the waterproof enclosure. Each seam is proportionately spaced within the waterproof enclosure. Each seam ending an identical distance that is spaced from the front end and along line 50 of FIG. 3.

Additionally, a generally rectangular headrest 52 is formed within the waterproof enclosure. As shown in FIG. 1, the headrest is adjacent the front end of the waterproof enclosure. The fill opening of the front end leads into the headrest. The fill opening allows ice as well as water to be placed within the headrest. The headrest functions like a pillow and is capable of having the surface tension adjusted. Adjusting the surface tension of the headrest will make it firm or pliable.

Figure 6:
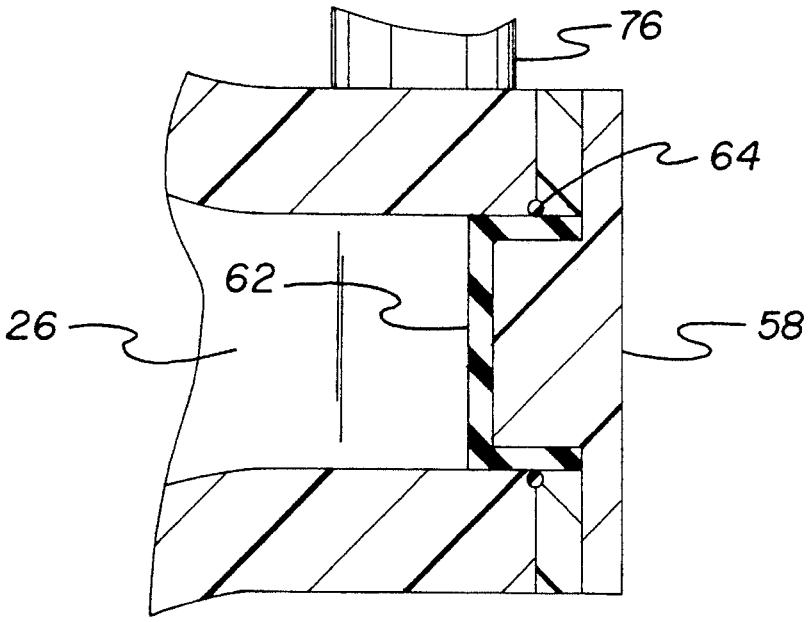
FIG. 6 is a fragmentary cross sectional view taken along line 6—6 of FIGS. 2 and 3.
Figure 7:
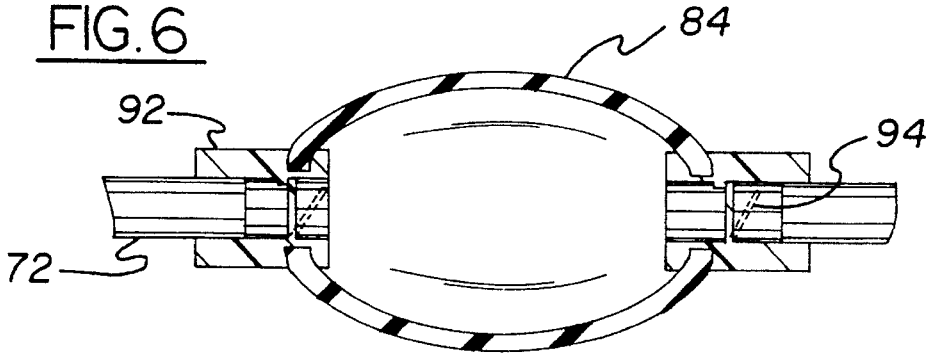
FIG. 7 is an enlarged cross sectional view of the bulb pump taken at position 7 of FIG. 3.

A generally rectangular lid 58 is provided. The lid is formed of a rigid plastic chosen from the groups of thermoplastic polymers commercially available. As shown in FIG. 2, the lid has one end 60 that is hingedly coupled to the front end 24 of the waterproof enclosure and adjacent the fill opening 26. The lid has a projection 62, as shown in FIG. 6, that is positioned within a fill opening of the front end. The projection has an O-ring 64 therearound and captures the amount of water within the waterproof enclosure. The O-ring ensures an airtight seal is formed between the lid and the fill opening. The lid is locked in position over the fill opening by a wing nut 68 secured to another end 70 of the lid.

Lastly, an elongated tubular hose 72 is included. The hose has a first end 74 that is attached to a fill valve 76, a second end 80 attached to a drain valve 82 and a bulb pump 84 between the valves. As seen in FIG. 1, the fill valve is coupled to a side 86 of the border along the front end 24. The drain valve is coupled to the rear end of the waterproof enclosure 18. When the waterproof enclosure is ready to be emptied, the drain valve is removed. With the drain valve removed, the water flows from the fill opening at a faster flow rate. The hose is slightly longer than the waterproof enclosure. Between the bulb pump and the drain valve is a C-plug 88. The C-plug provides a quick disconnect that allows the hose to drain. Also, the C-plug may be used as a quick and easy way to adjust the amount of water in the waterproof enclosure.

Furthermore, as shown in FIG. 6, the bulb pump 84 has a pair of pressure release valve attached thereto. The bulb is formed of a flexible rubber or plastic. The pressure release valves are formed of a rigid plastic and each has a valve door 94 therein. Each valve door of the bulb pump opens and closes as the bulb is squeezed. The hose is capable of providing circulation for the amount of water within the waterproof enclosure when the bulb pump is squeezed. In the present invention the bulb pump is a manual pump that is operable by hand, foot or body movement. The bulb pump may be replaced by an air battery-operated pump.

The present invention is an easy to use water filled mattress that has an elongated hose attached at a front end and a rear end. At the front end of the water filled mattress is a fill opening that has the diameter of about 3 inches so that ice can be placed within the waterproof enclosure of the mattress. The mattress itself has a length of about 72 inches. The user of the mattress can determine how firm or soft to make the waterproof enclosure by regulating the fill amount. Once the waterproof enclosure has been filled, additional adjustments need to be made. The user simply uses the C-clamp. The C-clamp allows for quick disconnect of the hoses and a controlled release of the water through the hose.

The present invention is very useful when camping. The present invention is easier on the back and allows the mattress to accommodate a variety of temperatures. The temperatures of the mattress is controlled by the temperature of the water that fills the mattress. The polyvinyl material used to make the waterproof enclosure of the mattress is capable of receiving hot water for warming in the coolness of winter.

Additionally, the material is capable of accommodating cold water and ice in the heat of summer. The bulb pump that is attached to the hose is used to recirculate the water contained within the mattress. Recirculation of the water within the mattress keeps the temperature of the mattress even throughout. Construction of the present invention consists of two pieces of reinforced plastic heat welded continuously around the perimeter. Once the sheets are welded together, heat welding is preformed intermittently to create lines throughout the interior of the waterproof enclosure that was formed. The lines form seams that create rows of tubular shapes. The rows of tubular shapes allows water to flow within the unit while limiting the thickness of the mattress. The front end of the mattress has a large cap. The large cap is adjacent a headrest that is formed within the waterproof enclosure.

The large cap allows ice and water to be poured into the waterproof enclosure. When filling the waterproof enclosure, leaving an air space in the headrest softens the headrest. Grommets are attached to the front end and rear end of the border of the mattress. The grommets allow the unit to be hung to dry before storage and to support the unit while filling.

A fill valve, a drain valve and a hose are attached to the waterproof enclosure. Attached to the hose is pump assembly. The pump allows the water in the waterproof enclosure to be recirculate back to the headrest and through the fill valve located near the lid after ice or hot water is added to the waterproof enclosure.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed and desired to be protected by Letters Patent of the United States is as follows:

1. A water fillable mattress comprised of a top sheet of flexible material sealed at its periphery to a bottom sheet of flexible material to define a generally rectangular waterproof enclosure having a front end and a rear end, a plurality of generally parallel heat welds joining said top sheet to said bottom sheet, extending from the rear end towards the front end, approximately 70% of the length of the enclosure, defining a plurality of generally parallel tubular rows, with the front area of the enclosure lacking the welds defining a generally rectangular headest area, a fill valve proximate the front end of the enclosure, and a drain valve proximate the rear end of the enclosure, and an elongated tubular hose, having a first end connected to the fill valve, a second end connected to the drain valve, a bulb pump located between the first and second end of the hose, whereby upon the repeated squeezing of the bulb pump, the water contained in the enclosure is circulated between the front and rear portions of the enclosure.

2. The mattress of claim 1, further including a plurality of spaced grommets positioned on a border region of the enclosure.

3. The mattress of claim 1, further including a fill opening and a lid having one end hingedly coupled to the front end of the waterproof enclosure while another end lockingly positioning the lid over the fill opening with a wing nut.

4. The mattress of claim 3, wherein the lid comprises a projection with an O-ring seal thereon.

5. The mattress of claim 3, wherein the fill opening is positioned adjacent the headrest area, and is of sufficient size to allow ice to be inserted within the headrest area.

* * * * *